US007729818B2

(12) United States Patent
Wheeler et al.

(10) Patent No.: US 7,729,818 B2
(45) Date of Patent: Jun. 1, 2010

(54) LOCOMOTIVE REMOTE CONTROL SYSTEM

(75) Inventors: Mark W. Wheeler, Palm Bay, FL (US); Mark Bradshaw Kraeling, Melbourne, FL (US)

(73) Assignee: General Electric Company, Schenectady, NY (US)

( * ) Notice: Subject to any disclaimer, the term of this patent is extended or adjusted under 35 U.S.C. 154(b) by 1673 days.

(21) Appl. No.: 10/931,391

(22) Filed: Sep. 1, 2004

(65) Prior Publication Data

US 2005/0125113 A1 Jun. 9, 2005

Related U.S. Application Data

(60) Provisional application No. 60/528,016, filed on Dec. 9, 2003.

(51) Int. Cl.
*B61L 17/00* (2006.01)

(52) U.S. Cl. ..... 701/19; 246/167 R

(58) Field of Classification Search ..... 701/2, 701/19–20, 23, 29, 32–33; 246/167 R, 182 R, 246/187 A, 187 C, 187 R; 340/3.1, 3.2, 3.21, 340/3.5, 825.7, 825.76, 825.21, 825.69, 825.38, 340/825.39, 825.52, 825.53
See application file for complete search history.

(56) References Cited

U.S. PATENT DOCUMENTS 4,711,418 A 12/1987 Aver, Jr. et al.
5,437,422 A * 8/1995 Newman ..... 246/5
5,685,507 A 11/1997 Horst et al.
6,135,396 A * 10/2000 Whitfield et al. ..... 246/182 R
6,417,765 B1 * 7/2002 Capanna ..... 340/435
6,470,245 B1 10/2002 Proulx
6,505,103 B1 * 1/2003 Howell et al. ..... 701/19
6,637,703 B2 * 10/2003 Matheson et al. ..... 246/124
6,658,331 B2 12/2003 Horst et al.
6,697,716 B2 2/2004 Horst
6,863,247 B2 * 3/2005 Horst ..... 246/187 A
6,996,461 B2 * 2/2006 Kane et al. ..... 701/19
7,069,122 B1 * 6/2006 Higgs ..... 701/19

(Continued)

FOREIGN PATENT DOCUMENTS

EP 0 849 138 6/1998

(Continued)

OTHER PUBLICATIONS

Straubler, Peter, Innovative Leit-und Sicherungstechnik fur Regionalbahnen, LST fur Regionalbahnen, XP-000779904, pp. 29-31.

*Primary Examiner*—Dalena Tran
(74) *Attorney, Agent, or Firm*—Robert Wawrzyn, Esq.; Terry M. Sanks, Esq.; Beusse Wolter Sanks Mora & Maire, P.A.

(57) ABSTRACT

A remote control system (10) for a locomotive (16) includes a sensor (e.g. 15) on-board the locomotive for providing locomotive information. The system also includes a transmitter (13) for transmitting the locomotive information from the locomotive to an operator control unit (OCU) (12) off-board the locomotive. A graphical display (24) is associated with the OCU for displaying the locomotive information in a graphical format to an operator of the OCU. A locomotive control unit (LCU) (14) in communication with the OCU is operable to control the locomotive in response to a manipulation of the OCU by the operator.

24 Claims, 1 Drawing Sheet

U.S. PATENT DOCUMENTS

| | | | | |
|---|---|---|---|---|
| 2002/0022984 | A1* | 2/2002 | Daniel et al. | 705/8 |
| 2002/0084387 | A1* | 7/2002 | Matheson et al. | 246/124 |
| 2002/0169530 | A1 | 11/2002 | Laguer-Diaz et al. | |
| 2003/0040853 | A1 | 2/2003 | Brousseau et al. | |
| 2003/0055666 | A1 | 3/2003 | Roddy et al. | |
| 2003/0182029 | A1 | 9/2003 | Horst et al. | |
| 2003/0222981 | A1* | 12/2003 | Kisak et al. | 348/148 |
| 2004/0064223 | A1 | 4/2004 | Horst et al. | |
| 2004/0090315 | A1 | 5/2004 | Mackjust et al. | |
| 2004/0111722 | A1* | 6/2004 | Horst et al. | 717/168 |

FOREIGN PATENT DOCUMENTS

| | | |
|---|---|---|
| RU | 2 092 355 | 10/1997 |
| RU | 2 139 215 | 10/1999 |

* cited by examiner

FIGURE
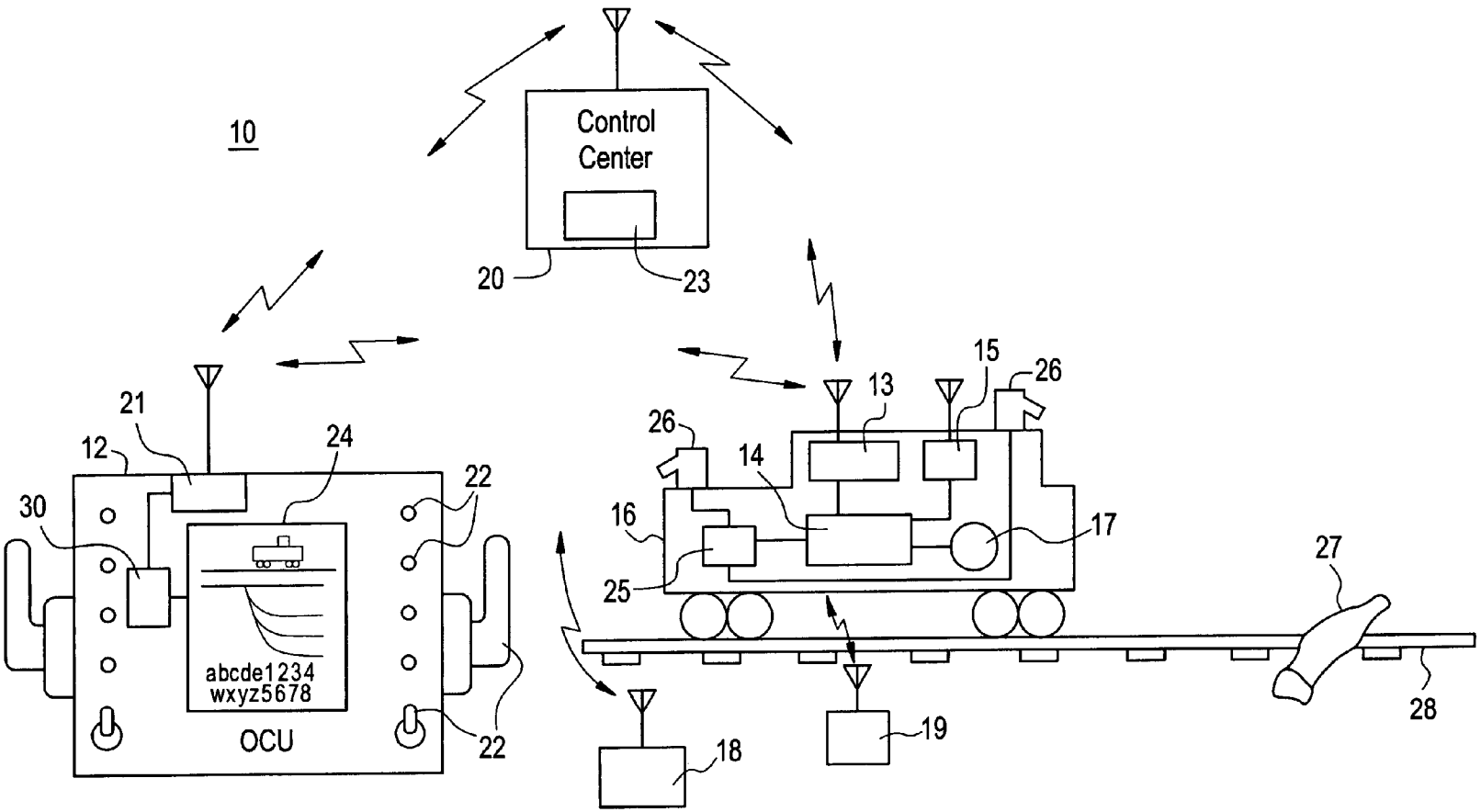

LOCOMOTIVE REMOTE CONTROL SYSTEM

CROSS REFERENCE TO RELATED APPLICATIONS

This application claims priority to U.S. Provisional Application Ser. No. 60/528,016 filed on Dec. 9, 2003, and incorporated herein by reference.

FIELD OF THE INVENTION

This invention relates to the field of remote control of locomotives, and in particular, to display of information on a remote radio transmitting device.

BACKGROUND OF THE INVENTION

It is known to remotely control locomotives in a switchyard using remote radio transmitting devices controlled by rail yard personnel. Modern remote control systems allow yard operators to control driverless, microprocessor-equipped switching locomotives controlled by an on-board Locomotive Control Unit (LCU) using a battery-powered portable Operator Control Unit (OCU) to be carried by an operator located adjacent to but off-board of the locomotive to be controlled. Two-way wireless communication is established between the OCU and the LCU. The operator controls the movement of the locomotive, while locomotive operating data and warnings are returned from the locomotive to the OCU. Locomotive data, such as speed and brake system pressure, and warnings are displayed to the operator via a two-line text message display included in the OCU.

BRIEF DESCRIPTION OF THE DRAWINGS

The sole FIGURE is a schematic representation of an improved locomotive remote control system providing enhanced integration into a rail yard environment.

DETAILED DESCRIPTION OF THE INVENTION

Prior art locomotive remote control systems have functioned as isolated devices that allowed an operator to control a locomotive remotely but that provided no information to the operator regarding the environment in which the locomotive was operating. The present invention expands the capabilities of a locomotive remote control system to improve the operator's ability to function in the context of a rail yard. Productivity and safety of remote locomotive control operations may be enhanced by adding new data processing, communication, and user interface capabilities, as described below.

An improved locomotive remote control system 10 is illustrated in the FIGURE as including an Operator Control Unit (OCU) 12 having a processor 30 and an OCU transmitter 21 in wireless communication with a locomotive transmitter 13 and Locomotive Control Unit (LCU) 14 on-board a remotely controlled locomotive 16. The wireless link may further include communications with wayside equipment 18 and/or with centralized control center 20. The OCU 12 includes various control levers, buttons, switches, and LED indicators 22 as may be known in the art. In addition, the OCU 12 includes a graphical display panel 24 for displaying information in a variety of formats to the operator. In contrast to the simple alphanumeric display used in the past, the graphical display panel 24 may be a CRT, LED, LCD, or plasma display or other graphical display component known now in the art or developed in the future, for example, of the type commonly used today on PDA devices. In an embodiment, the graphical display may be configured as a multifunction GUI. The display panel 24 may be an output device only, or it may be an input/output device such as a touch screen. The display panel 24 may replace or supplement the two-line alphanumeric display known in prior art operator control units.

Information representative of the layout and equipment of a track system in the rail yard is stored in a track database, for example in the control center 20 or locally, such as in a memory of the OCU 12. In one embodiment, a map of a switchyard in which the locomotive 16 is operating may be provided showing the location of one or more locomotives 16 relative to features of the rail line and/or other vehicles on the within the yard. Location information may be obtained by a GPS unit 15 on the locomotive 16, by using wayside sensors detecting each of a plurality of locomotives having unique identifiers, or by using transponders 19 transmitting location information to the locomotive 16. For example, transponders, such as AEI tags, positioned at known locations along a track wayside may be read by the locomotive 16 to provide location information to the locomotive 16 as the locomotive 16 passes the tag. The location information is transmitted to the OCU 12 from the locomotive 16, from wayside equipment 18, or from a control center 20. Regions of the switchyard wherein special operating constraints are established, such as reduced speed limit zones, may be highlighted on the display panel 24, such as by being displayed in a different color or with a flashing indicator. Warnings may similarly be highlighted on the display panel 24 by color, flashing indications or brightness variations, etc.

In another aspect, a plurality of OCU remotely controlled locomotives 16 operating in the railyard may each be assigned a unique identifier for receiving control instructions from a respective OCU 12. The location or each locomotive 16 in the railyard may be tracked, for example, by the control center 20. Each OCU 12 may be configured for addressing and communicating with a selected one of the locomotives having a certain unique identifier for controlling movement of the respective locomotive 16. The OCU 12 may display displaying information relating to the position of the locomotive 16 being controlled and may also display information relating to the respective positions of other locomotives 16 in the railyard not being controlled by that OCU 12.

In another embodiment, the display panel 24 may be used to display images observed by an imaging device, such as one or more cameras 26 located on the locomotive 16 or at another location associated with the rail line 28. To economize the use of available wireless bandwidth, the image communication transmitted to the OCU may be single frame information, or live image scenes may be transmitted only upon the request of the operator. A video processing system 25 associated with the camera(s) 26 may automatically sense an obstruction 27 on the rail 28 in the path of the locomotive 26 and may provide a warning to the operator. The video representation of the obstruction may interrupt certain other information being displayed on the display panel 24 or the operator may be prompted by the warning to request the display of video information. Other embodiments may utilize other types of sensors on the locomotive, such as sonar, ultrasonic, radar, IR, laser sensors, for example, and the images displayed on the display panel 24 may be actual images developed from these sensors and/or graphical representations of the information developed from such sensors. The imaging device 26 may be remotely controlled by instructions transmitted from the OCU 12. For example, at least one of the various control levers, buttons, and switches 22 may be configured to control the imaging device 26 based on positioning of appropriate control lever, button, and/or switch 22 by an operator. The images acquired by the imaging device 26 may also be transmitted to a display at the control center 20 and control signals to control the operation of the imaging device may be sent from the control center 20 to the imaging device 26 at the locomotive 16.

The movement of cars in a switchyard is a highly sophisticated and controlled process. Typically, a remote control locomotive operator will be given a hard copy (paper) of a switch list (work order) itemizing a desired configuration for a train to be assembled in the rail yard. The switch list details intended movements for the locomotive 16 within the rail yard. The operator follows the instructions on the switch list, and then reports back to a control center 20 via radio or in person upon completion of the movements itemized on the switch list. Physically moving to a location to receive the switch list may take a significant amount of time depending upon the location of the operator within the yard. Furthermore, paper switch lists are difficult to hold while operating an OCU 12, and they often are dropped or damaged by weather. In a further embodiment of the present invention, such work orders are stored in a database, such as a database 23 located in the control center 20, and are displayed to the operator via the display 24 on the OCU 12. Communication of the switch list to the operator is time-efficient and it eliminates the problems associated with a hard copy of the switch list. The operator may also communicate completion of the movements defined in the switch list back to the control center 20 via the OCU wireless link, such as by operating one of the various control levers, buttons, and switches 22 configured to transmit this information. Furthermore, deviations from the switch list may be communicated rapidly to the control center 20, such as when a defective railcar is discovered and is intentionally left out of a train.

Malfunctions of the locomotive 16 may be communicated to the OCU 12 and health status information for the locomotive 16 may be displayed to the operator via the display panel 24. Sensors 17 on-board the locomotive 16 monitor parameters indicative of the health of the locomotive 16. Such information is transmitted via the LCU 14 to the OCU 12 for display to the operator. A processor receives the health information and generates locomotive operational recommendations for display on the OCU 12. The health information may also be processed in the locomotive 16 or the control center 20 to generate operational recommendations for transmission to and display on the OCU 12. The information displayed may include a fault message, and it may further include instructions to the operator for repairing/overcoming the malfunction. A series of repair actions may be associated with each possible fault code, such as in a database stored in the control center 20, the OCU 12 or on-board the locomotive 16. When a malfunction occurs, the operator is guided through the repair actions via instructions displayed on the OCU 12. The instructions may include text, graphical and/or pictorial information, for example. The operator may acknowledge actions and/or provide other types of feedback via the display panel 24 or via other means to further the diagnostic process. A fault tree sequence is thus accomplished with the purpose of correcting the malfunction. Alternatively, the operator may receive operational recommendations instructing the operator to take the locomotive out of service, and/or to move the locomotive to a siding or service facility to more effectively make the repairs and not to impede the operation of the railyard. The operating parameters and/or service and operational recommendation may also be transmitted to a display at the control tower for supervisory review.

The response to certain emergency situations involving remotely controlled locomotives are known to include a timed countdown prior to the implementation of an action. The display panel 24 may be used to display such countdowns, either numerically or with a graphical representation, to provide the operator with enhanced knowledge of a pending automatic emergency action.

While various embodiments of the present invention have been shown and described herein, it will be obvious that such embodiments are provided by way of example only. Numerous variations, changes and substitutions will occur to those of skill in the art without departing from the invention herein.

We claim as our invention:

1. A remote control system for a locomotive comprising:

a sensor on-board a locomotive and providing locomotive information;

a transmitter transmitting the locomotive information from the locomotive to an operator control unit (OCU) off-board the locomotive;

a graphical display associated with the OCU for displaying the locomotive information in a graphical format to an operator of the OCU;

a locomotive control unit (LCU) in communication with the OCU and operable to control motion of the locomotive in response to a manipulation of the OCU by the operator; and a data base storing work orders itemizing a desired configuration for a train to be assembled in the railyard.

2. The system of claim 1, wherein the sensor comprises a location determination device for providing locomotive information comprising a location of the locomotive.

3. The system of claim 2, further comprising a track data base representative of a track layout in a railyard in communication with the OCU to allow the OCU to graphically display the location of the locomotive in the railyard relative to the track layout.

4. The system of claim 3, when used to control a plurality of locomotives in a railyard, each locomotive having a unique identifier, the system comprising a plurality of sensors for determining a respective location of each of the locomotives, and a transmitter on the OCU for addressing and communicating with a selected one of the locomotives for controlling movement of the selected one of the locomotives, with the OCU displaying the respective location of the selected one of the locomotives being controlled.

5. The system of claim 4, wherein the OCU displays the respective locations of other locomotives in the railyard different from the selected one.

6. The system of claim 2, wherein the location determination device comprises a GPS receiver.

7. The system of claim 2, wherein the location determination device comprises a transponder reader.

8. The system of claim 7, wherein the transponder reader comprises an automatic equipment identification (AEI) tag reader.

9. The system of claim 1, wherein the sensor comprises an imaging device for providing locomotive information comprising images observed from the locomotive whereby the images are displayed on the OCU remote from the locomotive being controlled by the OCU.

10. The system of claim 9 wherein the imaging device is a video camera.

11. The system of claim 9 wherein the imaging device is an ultrasonic device.

12. The system of claim 9 wherein the imaging device is a radar device.

13. The system of claim 9 further comprising a second imaging device, with one imaging device being located at the front of the locomotive and the other imaging device being located at the rear of the locomotive.

14. The system of claim 9 further comprising a transmitter on the OCU for transmitting a control signal controlling the operation of the imaging device.

15. The system of claim 9 further comprising an obstacle detection sensor for detecting obstacles within a predetermined distance of the locomotive.

16. The system of claim 1, further comprising a plurality of locomotives in the railyard each having a unique identifier, with the data base storing work orders itemizing desired configurations associated with specific locomotives and an OCU transmitter for transmitting the identifier of the locomotive to be controlled.

17. The system of claim 1, wherein the sensor comprises a locomotive health monitor for providing locomotive information comprising information indicative of the health of the locomotive.

18. The system of claim 17 further comprising a processor receiving the information indicative of the health of the locomotive and generating locomotive operational recommendations for display on the OCU.

19. The system of claim 17 further comprising a processor receiving the information indicative of the health of the locomotive and generating locomotive service recommendations for display on the OCU.

20. The system of claim 1, wherein the sensor comprises a locomotive condition monitor for providing locomotive information comprising information indicative of a condition of the locomotive.

21. The system of claim 20 further comprising a processor receiving the information indicative of the condition of the locomotive and generating a timed countdown indication responsive to the condition for display on the OCU.

22. A locomotive incorporating the remote control system of claim 1.

23. A remote control system for a locomotive comprising:

a sensor on-board a locomotive and providing locomotive information;

a transmitter transmitting the locomotive information from the locomotive to an operator control unit (OCU) off-board the locomotive;

a graphical display associated with the OCU for displaying the locomotive information in a graphical format to an operator of the OCU;

a locomotive control unit (LCU) in communication with the OCU and operable to control motion of the locomotive in response to a manipulation of the OCU by the operator;

a data base storing work orders itemizing a desired configuration for a train to be assembled in the railyard; and a data base transmitter for transmitting a work order to the OCU for a selected locomotive to be controlled by the OCU for movement in the railyard; whereby the work order is displayed at the OCU for completion of the work order by the OCU operator in controlling the movement of the locomotive in the railyard.

24. The system of claim 23 further comprising a data input device on the OCU for the OCU operator to give notice of completion of work on the work order.

* * * * *